US006429819B1

(12) United States Patent
Bishop et al.

(10) Patent No.: US 6,429,819 B1
(45) Date of Patent: Aug. 6, 2002

(54) DUAL BAND PATCH BOWTIE SLOT ANTENNA STRUCTURE

(75) Inventors: Bruce Bishop, Aptos; Ben Newman, Santa Cruz, both of CA (US)

(73) Assignee: Tyco Electronics Logistics AG (CH)

( * ) Notice: Subject to any disclaimer, the term of this patent is extended or adjusted under 35 U.S.C. 154(b) by 0 days.

(21) Appl. No.: 09/828,533

(22) Filed: Apr. 6, 2001

(51) Int. Cl.[7] ..... H01Q 21/00

(52) U.S. Cl. ..... 343/725; 343/700 MS; 343/767

(58) Field of Search ..... 343/700 MS, 702, 343/767, 770, 725, 727, 795

(56) References Cited

U.S. PATENT DOCUMENTS

| | | | | |
|---|---|---|---|---|
| 4,766,440 A | * | 8/1988 | Gegan | 343/700 MS |
| 5,043,738 A | | 8/1991 | Shapiro et al. | 343/700 |
| 5,166,697 A | * | 11/1992 | Viladevall et al. | 343/727 |
| 5,355,143 A | | 10/1994 | Zurcher et al. | 343/700 |
| 5,442,367 A | * | 8/1995 | Naito et al. | 343/700 MS |
| 5,608,413 A | * | 3/1997 | Macdonald | 343/700 MS |
| 5,668,558 A | | 9/1997 | Hong | 343/700 |
| 5,896,107 A | | 4/1999 | Huynh | 343/700 |
| 5,986,606 A | | 11/1999 | Kossiavas et al. | 343/700 |
| 6,002,367 A | | 12/1999 | Engblom et al. | 343/700 |
| 6,014,105 A | * | 11/2000 | Davis et al. | 343/700 MS |
| 6,198,437 B1 | | 3/2001 | Watson et al. | 343/700 |

* cited by examiner

*Primary Examiner*—Tan Ho
(74) *Attorney, Agent, or Firm*—Fulbright & Jaworski L.L.P.

(57) ABSTRACT

The present invention discloses a combination patch antenna element and bowtie-shaped slot antenna element together disposed upon a first major surface of a dielectric element. The bowtie-slot antenna element is defined upon the dielectric element within a boundary of the patch antenna element. The bowtie-slot antenna element defines a first antenna electrical resonance frequency characteristic, and the patch antenna element defines a second antenna electrical resonance frequency characteristic. The combination patch antenna element and bowtie-shaped slot antenna element are provided in relation to a ground plane element, such as provided by a printed wiring board of a wireless communications device. An additional optional feature of the antenna includes a plurality of conductive pattern enhancement elements disposed on an opposite side of the dielectric element.

16 Claims, 8 Drawing Sheets

FIG. 5C AZIMUTH POSITION IN CHAMBER
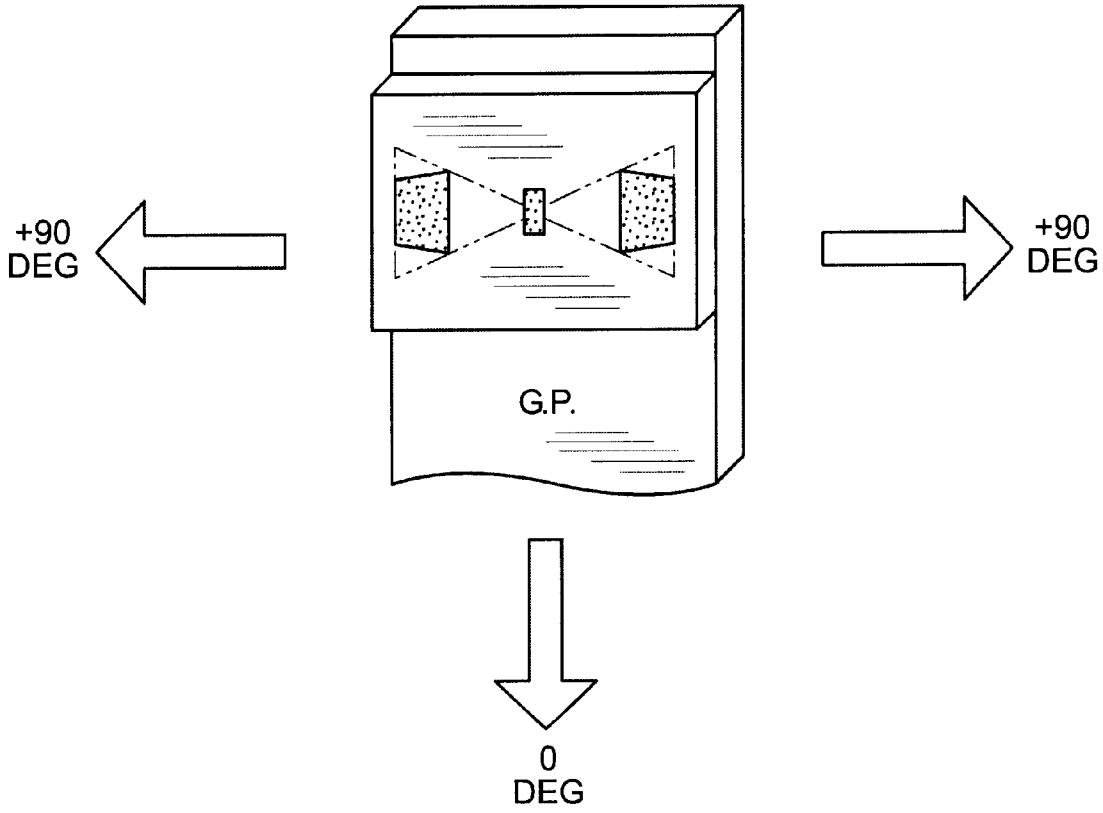

DUAL BAND PATCH BOWTIE SLOT ANTENNA STRUCTURE

FIELD OF THE INVENTION

The present invention relates to an antenna assembly suitable for wireless transmission of analog and/or digital data, and more particularly to a combination of a microstrip patch and a bowtie slot antenna radiating element enabling operation at dual frequency bands and featuring high gain in each band

BACKGROUND OF THE INVENTION

There exists a need for an improved antenna assembly that provides a single and/or dual band response and which can be readily incorporated into a small wireless communications device (WCD). Size restrictions continue to be imposed on the radio components used in products such as portable telephones, personal digital assistants, pagers, etc. For wireless communications devices requiring a dual band response the problem is further complicated. Positioning the antenna assembly within the WCD remains critical to the overall appearance and performance of the device.

Antenna assemblies compatible with printed circuit fabrication technologies are known and have found application in radar, satellite communication and other present day systems. In these antenna assemblies a conductive line or pattern realized in the form of printed circuit conductor is often used to communicate radio frequency energy to or from the antenna element.

One known antenna structure is the "patch" antenna. Such antennas may consist of a printed circuit conductor area of selected and resonance-based physical size disposed at the terminal point or other selected node along a radio frequency conductor. The patch antenna is found to be with several limitations; the primary of which is a limited bandwidth capability. Patch antenna bandwidth often extends over only a few percent of the antenna's design frequency and gives rise to difficulty in spread spectrum communications or multiple systems use applications of the antenna. The present invention in which the patch antenna is improved-upon by combining it with a selected additional form of bowtie slot antenna is believed to provide a desirable addition to the family of antennas usable with wireless communications devices.

SUMMARY OF THE INVENTION

The present invention provides a combination of a microstrip patch and a bowtie slot antenna radiating element enabling operation at dual frequency bands and featuring high gain (7–10 dBi) in each band. Additional features include excellent bandwidth (over 10%) for each band, and also enhanced performance and less pattern distortion as compared to either a typical patch or a typical bowtie slot antenna. The antenna device can be used for example, as a base station antenna, or micro cell, or access point site antenna, for wireless communication devices, such as cell phones, PDA's, laptop computers, or other devices which can employ wireless communication antennae. Another particular advantage of the invention is the ability to serve both frequencies using a single common feed.

The antenna radiating element can be fabricated using known printed circuit board fabrication techniques and processes. In one embodiment, the antenna radiating element is provided on a single printed circuit board of a dielectric material with two major surfaces or sides. The printed circuit board has copper plating on one or both sides of the dielectric material. In operation, the antenna is disposed in relation to a corresponding ground plane. On the first side, which faces the ground plane, the bowtie shape is defined and may be selectively etched from the conductive surface of the board material. On the second side, optional conductive antenna pattern enhancement elements can be disposed. In alternative embodiments, the antenna device can also be implemented using other manufacturing methods employing conductive material over dielectric material, such as plating, vapor deposition or plasma deposition of conductive material over non-conductive material, or could also be built using two-shot molding with selective plating, or other manufacturing methods as will be known or developed by those skilled in the art.

In one preferred embodiment (as shown in the enclosed figures,) an antenna according to the present invention serves as a dual band base station antenna to cover two frequency bands, namely GSM (880–960) MHz and 3 G UMTS Radio band (1.92–2.17) GHz. In other particular embodiments the invention can be implemented by one of ordinary skill in the art without an undue amount of experimentation, by scaling the dimensions, to provide dual ISM bands (2.4 and 5.8 GHZ), or also built to operate at the two frequency bands of ISM (2.4 GHz) and UNII (5.3 GHz), or other useful combinations of frequency bands. In each case, the two bands are fed with a single feed line and can be operated singularly or simultaneously. In one embodiment, the invention can be employed as a dual band antenna in conjunction with a multiband radio, with diplexers or other methods know in the art, to separate the bands. In another embodiment, the antenna could be used for either of the single bands provided, and is switched easily from one of the frequency bands to the other without modifications.

The frequencies of operation for a particular antenna embodiment can be implemented as follows; the low frequency band is primarily determined by the dimension 'D' of the patch antenna portion, as shown in FIG. 1, while the higher frequency band operating characteristics are primarily determined by the dimensions of the bowtie slot and the backside antenna pattern enhancement elements.

The invention can also be incorporated into an array of antenna structures to increase directivity and gain, and such an array of antenna elements can be integrated with a corporate feed network as illustrated in FIG. 6.

It is one object of the invention to provide a dual band antenna device with a single feedline.

It is a further object of the invention to provide a dual band antenna device with wide bandwith (on the order of 10%) for each frequency band.

It is a further object of the invention to provide a dual band antenna device with high gain in each band (on the order of 7–10 dBi).

It is a further object of the invention to provide a dual band antenna device where the two bands can be simultaneously accessed.

It is a further object of the invention to provide a dual band antenna device where either of the two bands can be operated singularly and interchangeably.

Additional objects and features of the invention will be understood from the following description and claims and the accompanying drawings.

DETAILED DESCRIPTION OF A PREFERRED EMBODIMENT

Figure 1A:
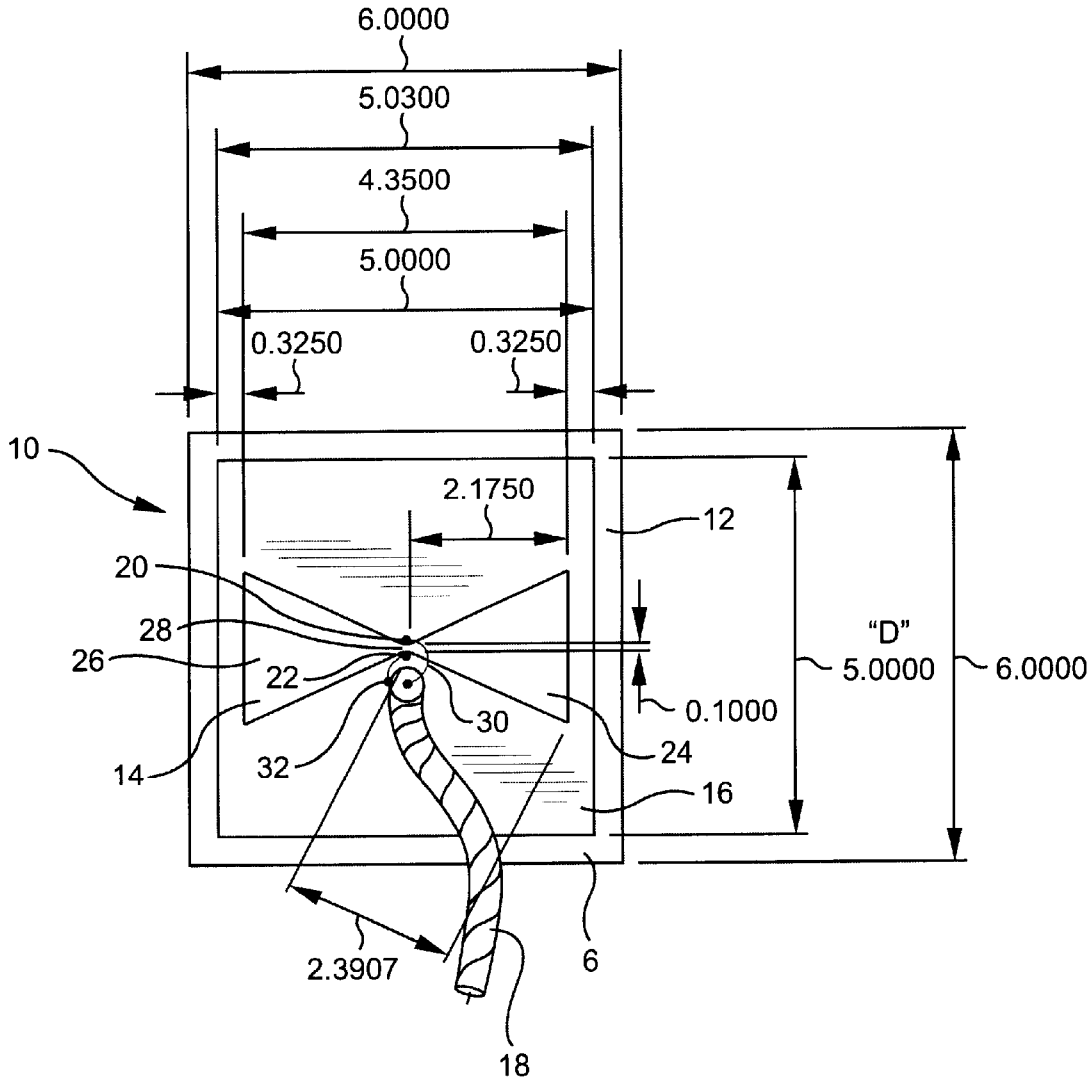
FIG. 1*a* shows a perspective view of the first side of the microstrip antenna radiating element of one embodiment of the present invention.

FIG. 1 is an enlarged perspective view of an antenna structure 10 according to the present invention. As may be observed in FIG. 1A, the present invention antenna has physical characteristics of both a patch antenna and a bowtie-slot antenna. The antenna 10 includes a dielectric substrate element 8, such as a printed circuit board, having conductive elements disposed thereupon. The antenna 10 is disposed in relation to a ground plane 6 associated with a wireless communications device. The ground plane 6 may be a separate conductive element, or may include all or part of the ground plane of the printed wiring board of a wireless device. An antenna 10 configured according to the dimensions shown in the FIG. 1 provides dual band frequency response to cover two cell phone bands, namely GSM (880–960) MHz and 3 G UMTS band (1.92–2.17) GHz. See, FIG. 4. The antenna of FIG. 1 can be used for both transmitting and receiving purposes, that is, electrical energy flow into or out of the antenna is contemplated.

The antenna 10 of FIG. 1 may be embodied using printed circuit techniques and includes an electrically insulating substrate 8 having first and second major surfaces 12, 13. On the first major surface 12, a conductive patch structure 16 having dimensions of 5.00 inches by 5.00 inches is provided. The conductive patch structure 16 is of a conductive material, and may be a copper plating disposed upon plated printed wiring board. The conductive patch structure 16 is a first band radiating element. Within the boundaries of the patch structure 16 is provided a second band radiating element 14 in the form of a bowtie-shape. The bowtie slot antenna element 14 may be considered a conductor-absent portion of the conductive patch structure 16, and is included within the overall boundary of the patch structure 16.

The substrate 8 of the FIG. 1 antenna may be made from a material such as Duroid®. A material other than this Duroid® may be used as the FIG. 1 antenna substrate where differing electrical, physical or chemical properties are needed. Such variation may cause electrical properties to change if not accommodated by compensating changes in other parts of the antenna as will be appreciated by those skilled in the electrical and antenna arts.

The conductive element 16 of FIG. 1 may be fabricated of such conductive materials as aluminum, gold, silver, copper and brass or other metals however for most uses of the antenna copper or copper alloyed or plated with another material is to be preferred. According to one aspect of the invention the use of copper along with photographic-based copper removal techniques as are commonly used in the printed circuit art are preferred in fabricating the antenna.

Figure 1B:
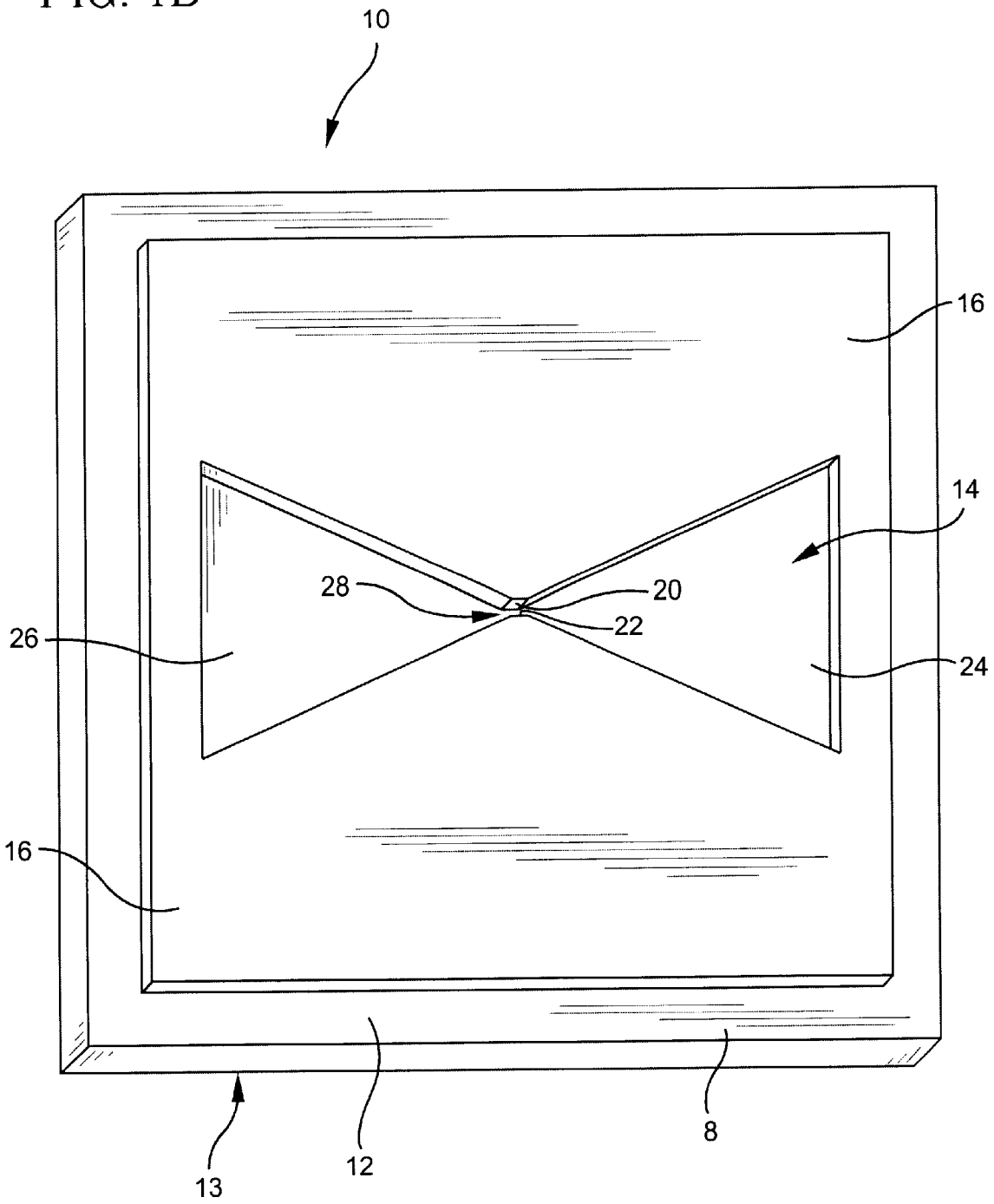
FIG. 1*b* is a detailed perspective view of FIG. 1*a*.
Figure 6:
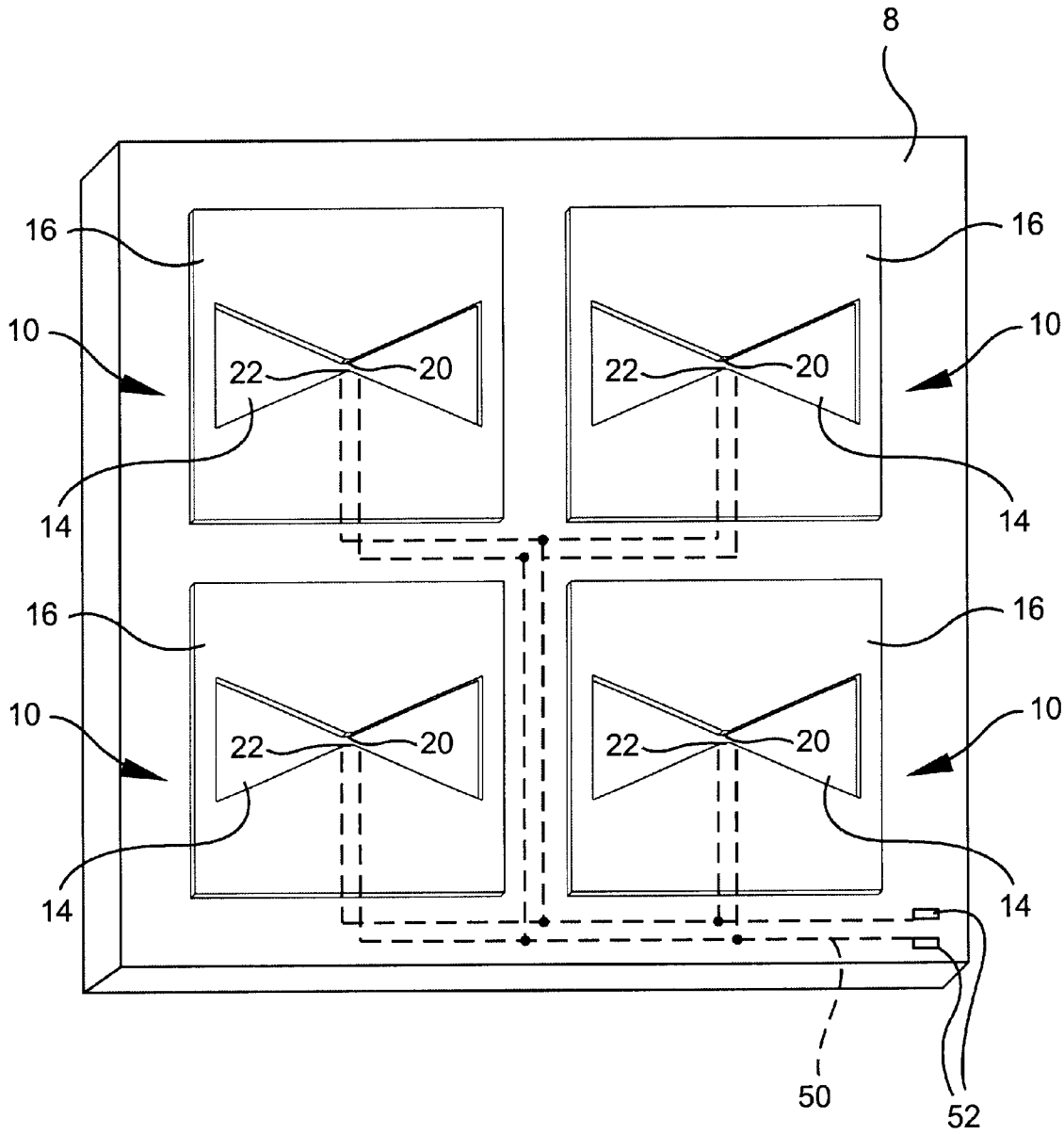
FIG. 6 is a perspective view of another embodiment of the invention, depicting a plurality of patch/bowtie-slot radiating elements disposed proximate a ground plane, and connected to a corporate feed system.

FIGS. 1*a* and 1*b* illustrate the first side 12 of a two-sided microstrip patch antenna radiating element 10 which features a bowtie shaped slot 14 etched into the conductive surface 16 of the first side of the antenna 10. The antenna feed 18 is attached across the gap 28 between the midpoints 20 and 22 of the converging region of the bowtie segments 24 and 26. The bowtie segments 24, 26 provide additional bandwidth as compared to rectangular slot antenna. Gap 28 is approximately 0.1 inch in dimension. In the embodiment as illustrated, the feed line 18 is a coaxial cable, with the inner coax portion 30 attached to converging point 20, and the outer shield grounding portion 32 of the coax attached to converging point 22. The coaxial portions 30 and 32 can be attached to the conducting surface 16 at points 20 and 22 respectively, by conventional soldering techniques. Alternatively, the feed system could also be provided using microstrip transmission lines (as shown in FIG. 6) or other feed systems as are known or may be developed by those skilled in the art, including but not limited to direct feed systems and capacitive feed systems.

Figure 2:
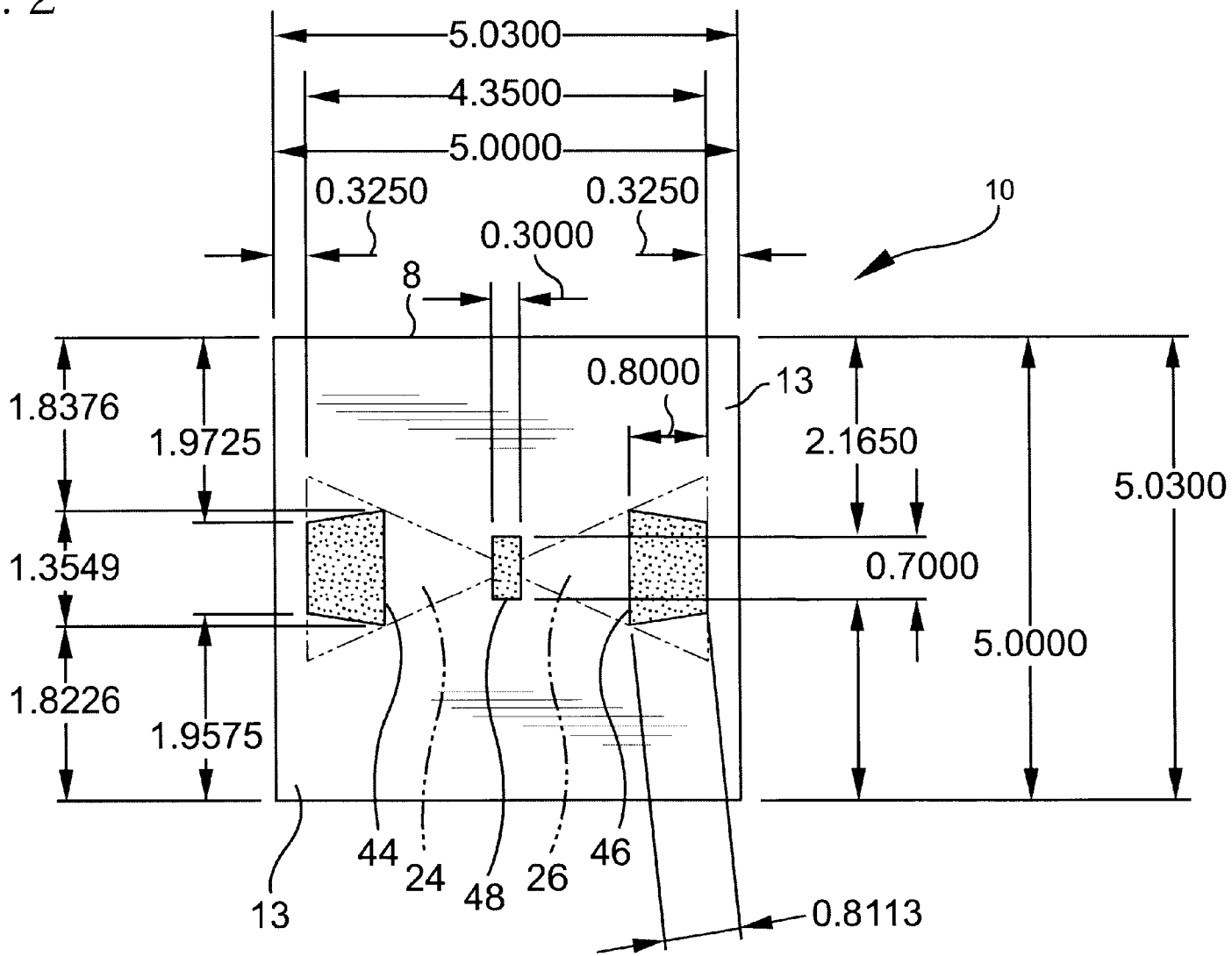
FIG. 2 shows a perspective view of the second side of the microstrip antenna radiating element of one embodiment of the present invention.

FIG. 2 illustrates the second side 13 of the dielectric board 8 of the preferred embodiment of the microstrip patch antenna radiating element 10. Conductive elements 44 and 46 are optional and can be provided on the second side 13 as antenna pattern enhancement elements. Elements 44 and 46 correspond to and are placed opposite to the bowtie segments 24 and 26 of the first side 12 of the antenna radiating element device 10. The size and shape of the pattern enhancement elements 44 and 46 can be varied in order to adjust the antenna performance pattern. In one preferred embodiment as illustrated, the size and placement are provided to produce an enhance antenna performance pattern. As illustrated in FIG. 2, the placement of the pattern enhancement elements 44 and 46 may be associated with conductive edges of the bowtie slot antenna element 14 of the reverse side 12. An additional conductive element 48 is also optionally provided on the second side 42 of the antenna device 10. Conductive element 48, when placed on the second side 42 opposite the gap 28 of the first side, can be used to facilitate impedance matching. The size and shape of conductive element 48 as illustrated provides an input impedance of approximately 50 ohms. Variations in the position, size and/or shape of the conductive elements 48 may alter the input impedance of the antenna element 10.

Figure 3:
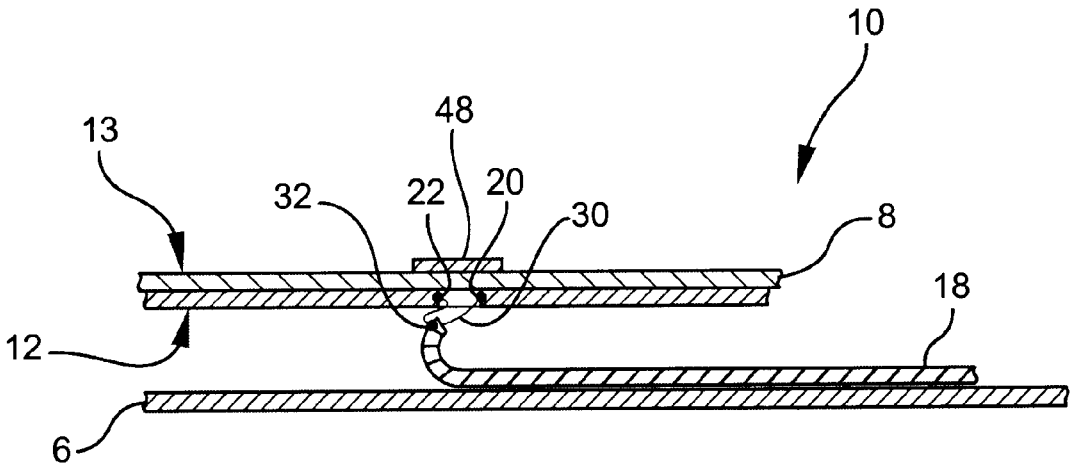
FIG. 3 shows a perspective view of one embodiment of the invention, depicting the radiating element disposed above a ground plane, and connected to a coaxial feed system.

FIG. 3 shows one embodiment of the radiating element 10 of this invention, disposed above a ground plane 6, and incorporating a coaxial feedline 18. The minimum ground plane 6 dimensions for preferred operation of the antenna 10 are $\lambda/2\times\lambda/2$ at a lower frequency within the frequency range of operation. In the embodiment of FIG. 1, the ground plane 6 is approximately 6 inches square. The outer shield 32 of the coax is operatively coupled to the radiating element 10 at the ground connection point 22. The inner feed line 30 is operatively connected to the feed connection point 20 as described above. The inner feedline 30 originates from an appropriate radio transceiver component for proper operation of the device (not shown). The outer shield 32 of the coax feedline 18 is also operatively connected to the ground plane 8, such as by soldering. Other types of feed systems may also be employed as are known to those skilled in the art.

Figure 4:
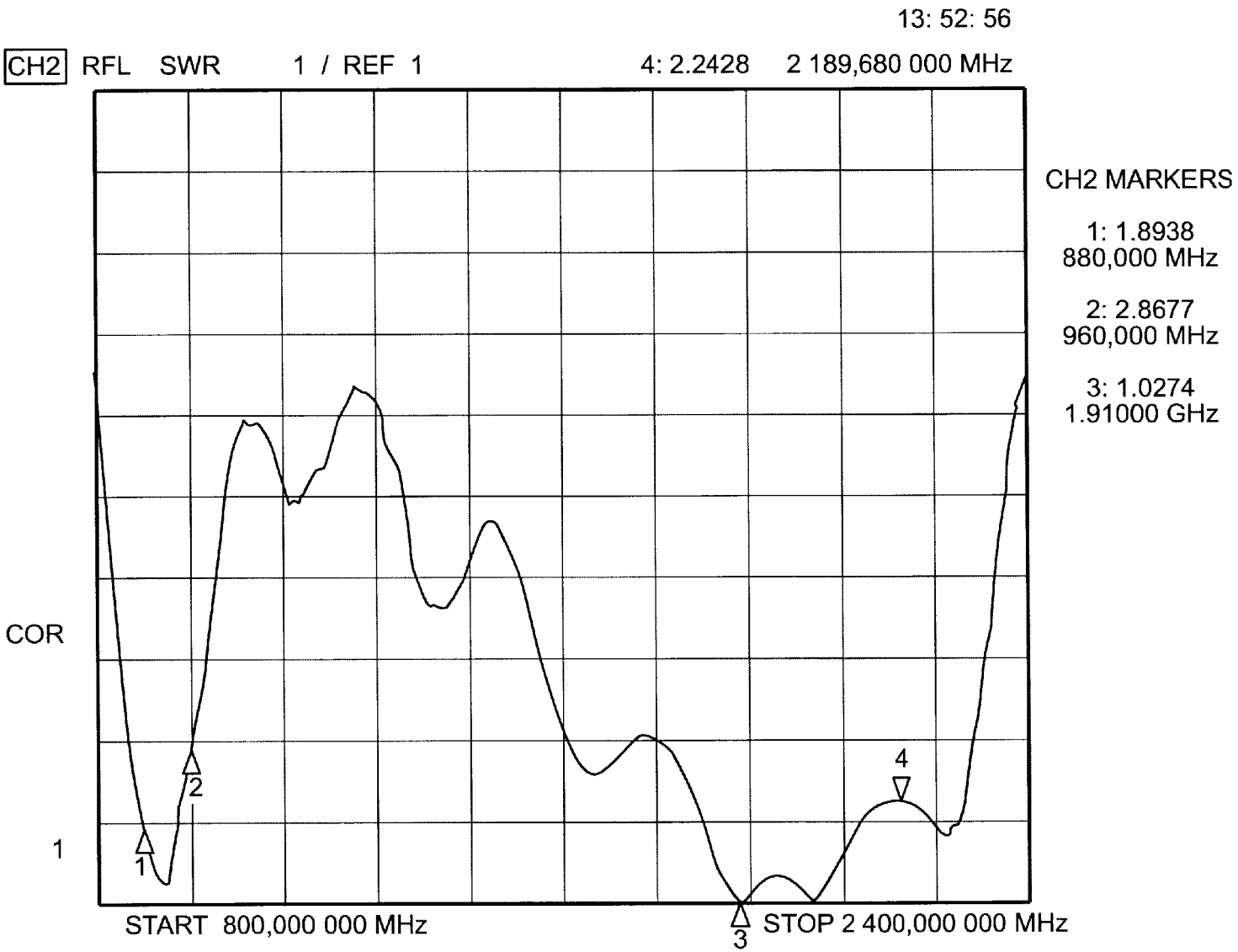
FIG. 4 is a VWSR vs. frequency plot of the microstrip antenna of the present invention featuring WCDMA and European cell phone frequency bands.

FIG. 4 shows a frequency versus the voltage standing wave ratio (VSWR) plot for the antenna shown in the FIG. 1 and FIG. 2 drawings. The vertical axis of FIG. 4 represents VSWR.

Figure 5A:
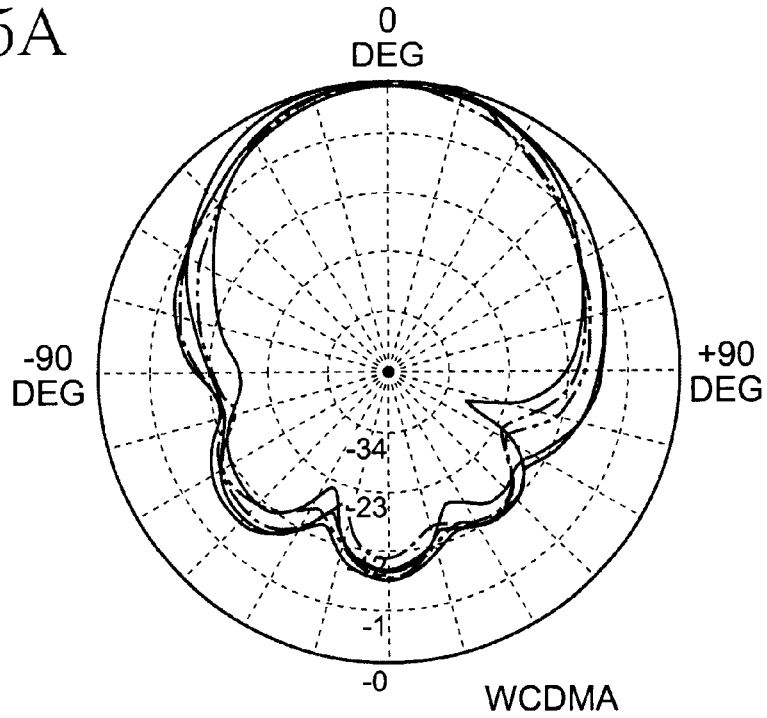
FIG. 5 is a polar chart of gain characteristics of the preferred embodiment of the microstrip antenna radiating element of the present invention featuring WCDMA and European cell phone frequency bands.
Figure 5B:
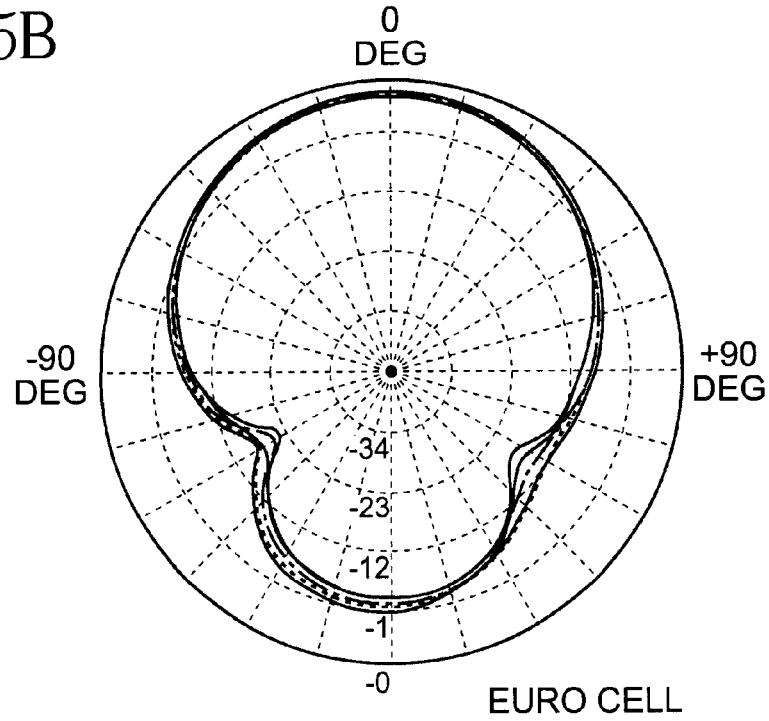

FIG. 5. includes polar charts of gain characteristics of the preferred embodiment of the microstrip antenna radiating element of the present invention featuring WCDMA and European cell phone frequency bands.

FIG. 6 illustrates another embodiment of the present invention having a plurality of combined bowtie slot and patch antenna elements 10 disposed upon a single dielectric substrate 8. Each antenna element 10, similar to the embodiments of FIGS. 1–2, are fed across the gap 28 of the bowtie element 14, i.e. at locations 20 and 22. The feed structure may be a microstrip transmission line structure 50 connected to a signal port 52. Alternative feed structures may also be practicable, including but not limited to coaxial lines, etc.

While the apparatus and method herein described constitute a preferred embodiment of the invention, it is to be understood that the invention is not limited to this precise form of apparatus or method and that changes may be made therein without departing from the scope of the invention which is defined in the appended claims. Other aspects and advantages of the invention as taught, enabled, and illustrated herein are readily ascertainable to those skilled in the art to which the present invention is directed, as well as insubstantial modifications or additions, all of the above of which falls clearly with the spirit and scope of the present invention as defined and specifically set forth in each individual claim appended hereto. The following drawings are intended to illustrate one ore more embodiments of the present invention and are not intended to limit the scope and breadth of the invention hereof, which invention shall be as broad and have reach as defined in the claims appended hereto and in reference to the whole of the disclosure hereof as understood by those of skill in the art of wireless technology generally, and the science and art of antenna and antenna system design, operation, and manufacture.

What is claimed is:

1. A dual band antenna assembly for a wireless communications device, said dual band antenna assembly comprising:

a conductive ground plane member operatively coupled to the wireless communications device;

a substantially planar dielectric element disposed a distance away from the ground plane member;

a patch antenna element disposed upon a first major surface of the dielectric element in the direction toward the ground plane member; and a bowtie-slot antenna element defined upon the dielectric element within a boundary of the patch antenna element, said bowtie-slot antenna element having a gap structure within a narrowed region, said gap structure having a pair of opposed sides with one side being conductively coupled to a signal conductor and the other side being conductively coupled to the ground plane member, wherein the bowtie-slot antenna element has a first antenna electrical resonance frequency characteristic, and wherein the patch antenna element has a second antenna electrical resonance frequency characteristic.

2. The dual band antenna assembly of claim 1 wherein the patch antenna element is generally rectangularly shaped.

3. The dual band antenna assembly of claim 2 wherein the generally rectangularly shaped electrically conductive patch antenna element is square in shape and has dimensions selected in response to antenna operating frequency.

4. The dual band antenna assembly of claim 1 wherein the first electrical resonance frequency characteristic and the second electrical resonance frequency characteristic comprise at least two different resonance frequencies.

5. The dual band antenna assembly of claim 4 wherein the two different resonance frequencies are GSM (880–960) MHz and 3 G UMTS (1.92–2.17) GHz.

6. The dual band antenna assembly of claim 1 wherein said antenna assembly is one of a plurality of similar antenna assemblies disposed in an array.

7. The dual band antenna assembly of claim 1 further comprising:

a plurality of conductive pattern enhancement elements on a second major surface of the dielectric element in the direction away from the ground plane member.

8. A method of fabricating a dual band antenna assembly comprising the steps of:

providing a wireless communications device having a ground plane structure and a signal generating/receiving component;

providing a dielectric board element disposed a distance away from the ground plane structure;

providing a patch antenna element disposed upon a first major surface of the dielectric element in the direction toward the ground plane member; and providing a bowtie-slot antenna element defined upon the dielectric element within a boundary of the patch antenna element and having a pair of interior signal coupling locations proximate a narrowed region of the bowtie-slot antenna element;

coupling said bowtie-slot antenna element at the pair of interior signal coupling locations wherein one of the signal coupling locations is conductively coupled to a signal conductor and the other signal coupling location is conductively coupled to the ground plane structure;

tuning physical dimensions of the patch antenna element to resonate at first resonant frequencies within an operating frequency band; and tuning physical dimensions of the bowtie-slot antenna element to resonate at second resonant frequencies within an operating frequency band.

9. The method of fabricating a dual band antenna assembly of claim 8 further comprising the steps of:

providing a plurality of conductive pattern enhancement elements on a second major surface of the dielectric element in the direction away from the ground plane structure; and tuning physical dimensions of one or more of the plurality of conductive pattern enhancement elements to provide an enhanced antenna characteristic.

10. A dual band combination patch element and bowtie-slot element antenna apparatus comprising the combination of:

a dielectric board element;

a patch antenna element disposed upon the dielectric board element, said patch antenna element having approximately half wavelength physical dimensions, said patch antenna element having a first antenna electrical resonance frequency characteristic; and a bowtie-shaped slot antenna element disposed within the patch antenna element and having a second antenna electrical resonance frequency characteristic, said bowtie-slot antenna element having a gap structure within a narrowed region, said gap structure having a pair of opposed sides with one side being coupled to a signal conductor and the other side being conductively coupled to a ground conductor.

11. The dual band antenna apparatus of claim 10 further comprising:

a plurality of conductive antenna pattern enhancement elements disposed upon a major side of the dielectric board element opposite to the patch antenna element and the bowtie-shaped slot antenna element.

12. The dual band antenna apparatus of claim 10 wherein the patch antenna element is generally rectangularly shaped.

13. The dual band antenna apparatus of claim 10 wherein the first electrical resonance frequency characteristic and the second electrical resonance frequency characteristic comprise at least two different resonance frequencies.

14. The dual band antenna apparatus of claim 13 wherein the two different resonance frequencies are GSM (880–960) MHz and 3 G UMTS (1.92–2.17) GHz.

15. The dual band antenna apparatus of claim 10 wherein said antenna apparatus is one of a plurality of similar antenna apparatuses disposed in an array.

16. The dual band antenna apparatus of claim 15 wherein the plurality of similar antenna apparatuses are coupled to a single feed port.

* * * * *